United States Patent [19]

Uhlmann et al.

[11] 3,950,977

[45] Apr. 20, 1976

[54] DRAWING OF ELONGATED STOCK

[75] Inventors: Otto Uhlmann, Burgdorf; Norbert Stephan, Ahlem, both of Germany

[73] Assignee: Kabel-und Metallwerke Gutehoffnungshutte Aktiengesellschaft, Hannover, Germany

[22] Filed: Jan. 23, 1975

[21] Appl. No.: 543,442

[30] Foreign Application Priority Data

Jan. 28, 1974 Germany ..... 2403910

[52] U.S. Cl. ..... 72/281; 72/289

[51] Int. Cl.[2] ..... B21C 1/02

[58] Field of Search ..... 72/274, 281, 289, 280; 242/78, 79, 80, 81

[56] References Cited

UNITED STATES PATENTS

| | | | |
|---|---|---|---|
| 1,578,351 | 3/1926 | Nullmeyer | 72/281 |
| 1,629,524 | 5/1927 | Nullmeyer | 72/281 |
| 2,049,053 | 7/1936 | Evans | 72/280 |
| 3,319,451 | 5/1967 | Tommarello | 72/287 |
| 3,462,992 | 8/1969 | Richards et al. | 72/280 |
| 3,496,751 | 2/1970 | Knouse | 72/280 |
| 3,593,558 | 7/1971 | Sperduti | 72/289 |

*Primary Examiner*—Milton S. Mehr

*Attorney, Agent, or Firm*—Ralf H. Siegemund

[57] ABSTRACT

A single capstan drum is used to pull alternatingly e.g. tubing through dies and coiling it on the periphery of the drum. The tubing to be drawn is taken from different stores, and while the tubing from one store is drawn, the other die and tubing of another store is prepared and inserted into that die, so that upon change-over the drum has to be halted merely briefly to fasten the end of the prepared tubing to the drum's periphery. The drawn tubing which was coiled dropped off the drum as soon as its end had left the respective die.

3 Claims, 2 Drawing Figures

DRAWING OF ELONGATED STOCK

BACKGROUND OF THE INVENTION

The present invention relates to drawing of elongated stock to be withdrawn from a suitable store (drum, spool, vessel, etc.) and under utilization of straightening equipment, drawing die equipment and equipment for pulling the stock through the straightening and drawing equipment.

Drawing of elongated stock, particularly metal tubing usually requires one end of the tubing to be passed through the die to permit gripping of that end on the other side of the die by means of particular clamps on a take up, coiling and capstan drum. As this drum rotates, the stock as pulled through the drawing die for reduction of the cross-sectional dimensions of that tubing.

The stock used here is comprised, for example, of tubing which has been extruded from a billet and is subsequently passed through a rolling mill to stretch roll or the like the tubing for reducing its diameter. These steps preceding drawing involve inherently tubes of short length. The stock drawn is accordingly not too long. On the other hand, drawing speeds used today are quite high so that the idle periods between drawing passes have about the same duration as the respective periods of drawing. Thus, the drawing proper has a duty cycle of only about 50%. Production speed is, therefore, limited by the duration of the period between two drawing passes. The preparation for the next pass can be carried out to some extent only during the current pass, such as introducing a mandrel into the next tubular blank and to form a pointed end to be inserted into and threaded through the die. Threading the tube end into the die, and fastening it to the pulling drum has to wait until the current pass has been completed.

Additionally, it has to be considered that the tubular stock to be drawn may arrive in coiled configuration, so that the length of tubing has to pass through straightening rolls before being pulled through a drawing die. Threading the end portion through the tubing is another preparatory step to be carried out before this particular length can be stretch formed.

DESCRIPTION OF THE INVENTION

It is an object of the present invention to improve the drawing operation of elongated stock generally so as to reduce the time between passes.

It is a specific object of the invention to improve the equipment for pulling elongated stock through a drawing die.

In accordance with the preferred embodiment of the invention, it is suggested to provide a single pulling drum for pulling elongated stock e.g. alternatingly through two different dies fed with stock from different stores. This way the drawing process for stock from one store can be prepared completely while the stock from the other store is being drawn. For a changeover from one die to the other one, one merely needs to fasten the end of the fresh stock to the drum. Idle time is drastically reduced in this manner. If the stock arrives in coiled configuration, separate straightening rolls are to be provided in front of each die. The preparation will include then the threading of the fresh stock through the currently idle set of rolls.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
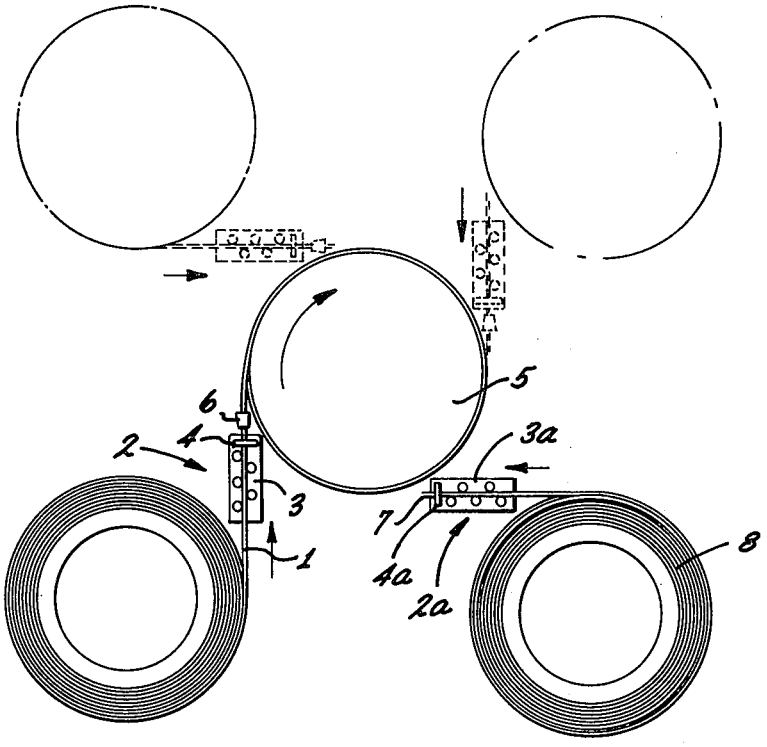
FIG. 1 is a schematic top elevation of an apparatus in accordance with the preferred embodiment of the invention.

Proceeding now to the detailed description of the drawing, stock to be drawn, for example copper tubing, is provided as coiled stock 1 in baskets, on spools or even loosely coiled. One end of the tubing is prepared to have a pointed end, after a mandrel has been inserted. This pointed end has then been passed through straightening rolls 3 and inserted into a die 4. The set of rolls 3 and the die 4 together form a tube drawing unit or tool 2.

The pointed end when inserted in that tool 2, projects through the die thereof and when ready, it is fastened onto a pulling drum 5 by means of a fastening clamp 6. The drum 5 is rotated by a suitable motor in the direction of the arrow to pull the tubing through the straightening rolls 3 and the die 4.

As the drum 5 rotates the copper tubing is uncoiled from store 1 is straightened by rolls 3 and drawn through die 4 to be reduced in size to the dimensions of the inserted mandrel and the opening of the die. The drawn tube is coiled onto drum 5. The coils thus produced are held on the drum 5 by operation of the tension resulting, on the one hand, from the drive force and pulling of the drum and its drive, and on the other hand, from the retardation by and reaction into the die 4 and its mounting block.

The drum and its axis have vertical disposition, so that the coils are produced in horizontal planes. As soon as all of the tubing has passed through die 4, the tension is relieved, and as the fastener 6 opens or is being opened, the wound coils drop into a store (not shown) underneath drum 5.

While the afore described stretch forming took place, tubing in a store 8 has been prepared, i.e. its one end has been reduced for threading through a die opening, a mandrel has been inserted just before that. The tubing has been inserted in a set of straightening rolls 3*a* of a second unit 2*a* which includes also a drawing die 4*a*, and that tube end is also threaded through the opening of that second die 4*a*.

As soon as the coils from the previous drawing step involving the stock from store 1 have dropped off drum 5, fastener 6 is used to clamp the end of the tubing from store 8, whereupon drawing preceeds but using stock from store 8. Thus, the idle time between two straightening and drawing passes is really only the period between passage of the rear end of tubing through die 4, until completing of fastening the front end of tubing from store 8 to fastener 6 on drum 5.

While the tubing from store 8 is stretch formed by drawing it through die 4*a*, a new store 1 is put into place and all of the preparations for a new pass including threading through rolls 3 and die 4 take place while drawing from the stock from store 8 continues.

The dashed portion of FIG. 1 serves merely to indicate that the two stores can be positioned anywhere around the periphery of drum 5. Placement will be dictated primarily on the basis of ease for access and available space. Also, the stores with fresh tubular stock will arrive at some point and should be easy and fast to be moved in position in relation to the straightening rolls and drawing dies.

However, the Figure can be interpreted also as illustration for the use of more than two sets of straightening rolls and dies. Particular circumstances may cause the preparations to take quite a long time in relation to the duration of a drawing pass. This may happen particularly when the stock is rather short so that each drawing step takes a short time only.

Figure 2:
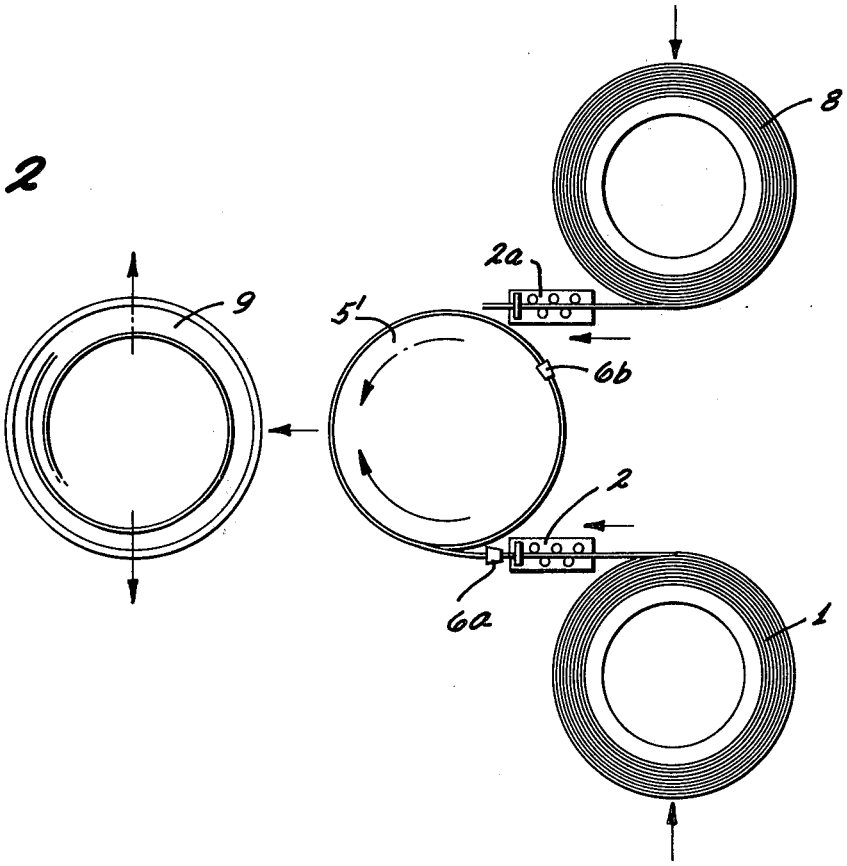
FIG. 2 is a similar view of a modified example for such embodiment.

The example of FIG. 2 is provided for pulling stock through the dies in parallel directions; accordingly, the pulling drum 5' can be driven in opposite directions. Please note, that it has to stop anyway for purposes of fastening the end of the next tubing to be drawn.

The drum 5' has two fastening clamps, 6*a* and 6*b* unless a single clamp is provided for pivoting; the respective fastening clamp may have to point always in the particular direction of the arriving drum stock and in tangential disposition of the tubing as coiled on drum 5.

Otherwise, the operation is analogous to the operation outlined above with reference to FIG. 1. While stock from one store is drawn and coiled onto drum 5', the other store is placed in position, the mandrel is inserted and the tube end is prepared for insertion into the respective die. After the prior pass has been completed, the drum is stopped in a position of alignment of the new tube end and of the clamp, or of the proper (respective other) clamp, to permit fastening to the drum whereupon drawing is resumed, but now in the other direction as far as rotation of the drum 5' is concerned.

Drawn tubing drops off drum 5' upon completion and is laterally removed as coiled stock 9 to undergo, for example, another stretch forming operation and to reduce the tubing further in cross-section or to process it otherwise.

The equipment as outlined above reduces idle time by about 50 percent so that production can be increased by up to 20 percent.

The invention was described with reference to equipment also known under the designation bull block; one can however use so called spinner block and wherein coiled stock is taken from baskets.

The invention is not limited to the embodiments described above but all changes and modifications thereof not constituting departures from the spirit and scope of the invention are intended to be included.

We claim:

1. Apparatus for drawing elongated tubular stock comprising:

a single pulling drum with means for fastening one end of such tubular stock to be drawn;

a plurality of drawing dies disposed around the periphery of said drum respectively for drawing tubular stock taken from one of a plurality of different stores, through only one of said dies at a time and as said tubular stock is being uncoiled from one of said stores and coiled onto the rotating drum, whereby tubular stock drawn by different ones of the dies is coiled onto the drum at different locations, the other die or dies are being prepared for drawing uncoiled tubular stock from a different store or the plurality of stores; and a plurality of sets of straightening rolls, the sets being respectively disposed in front of the dies, the set of rolls in front of the one die straightening the tubular stock prior to drawing by the one die, another one of the sets of the plurality holding the beginning of tubular stock from the different store in the respective die prior to being used next following exhaustion of the one store.

2. Apparatus as in claim 1, wherein the drum has vertical disposition and a vertical axis of rotation.

3. Apparatus as in claim 1, wherein two drawing dies are disposed for obtaining drawing in parallel directions, the drum provided for rotating in opposite directions.

* * * * *